US006939509B2

(12) United States Patent
Kochanek

(10) Patent No.: US 6,939,509 B2
(45) Date of Patent: Sep. 6, 2005

(54) METHOD FOR MANUFACTURING METAL PARTS

(75) Inventor: Wolfgang Kochanek, Neustadt/Weinstr. (DE)

(73) Assignee: Manfred Endrich, Karbach (DE)

( * ) Notice: Subject to any disclaimer, the term of this patent is extended or adjusted under 35 U.S.C. 154(b) by 0 days.

(21) Appl. No.: 10/239,649

(22) PCT Filed: Mar. 22, 2001

(86) PCT No.: PCT/EP01/03287

§ 371 (c)(1),
(2), (4) Date: Dec. 23, 2002

(87) PCT Pub. No.: WO01/72456

PCT Pub. Date: Oct. 4, 2001

(65) Prior Publication Data

US 2004/0067152 A1 Apr. 8, 2004

(30) Foreign Application Priority Data

Mar. 24, 2000 (DE) ..... 100 14 403

(51) Int. Cl.[7] ..... B22F 3/10
(52) U.S. Cl. ..... 419/36; 419/31
(58) Field of Search ..... 419/31, 36, 37

(56) References Cited

U.S. PATENT DOCUMENTS

| | | | | | |
|---|---|---|---|---|---|
| 3,811,878 | A | * | 5/1974 | Chao et al. | 419/37 |
| 3,989,518 | A | * | 11/1976 | Rueckl | 419/28 |
| 4,064,331 | A | * | 12/1977 | Patton et al. | 429/221 |
| 4,169,730 | A | * | 10/1979 | Matthews et al. | 420/476 |
| 4,391,772 | A | * | 7/1983 | Bonnor et al. | 419/23 |
| 4,404,166 | A | | 9/1983 | Wiech, Jr. | |
| 4,415,528 | A | | 11/1983 | Wiech, Jr. | |
| 4,445,936 | A | | 5/1984 | Wiech, Jr. | |
| 5,362,791 | A | | 11/1994 | Ebenhoech et al. | |
| 5,380,476 | A | * | 1/1995 | Matsushita et al. | 264/645 |
| 6,376,585 | B1 | * | 4/2002 | Schofalvi et al. | 524/195 |

FOREIGN PATENT DOCUMENTS

| | | | | |
|---|---|---|---|---|
| DE | 27 04 290 | | 8/1977 | |
| DE | 38 08 123 | A1 | 7/1988 | |
| EP | 0 125 912 | B2 | 9/1987 | |
| EP | 0 324 507 | | 7/1989 | |
| EP | 0 468 467 | | 1/1992 | |
| EP | 0 587 953 | | 3/1994 | |
| EP | 0 465 940 | B1 | 5/1995 | |
| GB | 645 030 | | 10/1950 | |
| JP | 0468467 | A2 * | 1/1992 | B22F/3/00 |
| WO | WO 00/76698 | | 12/2000 | |

* cited by examiner

*Primary Examiner*—Daniel Jenkins
(74) *Attorney, Agent, or Firm*—Foley & Lardner LLP

(57) ABSTRACT

The invention relates to a method for producing metal bodies by mixing metal compound particles with a binding agent and compacting them to form shaped parts, whereby the binding agent is subsequently removed and the metal compound is reduced to metal by gassing the same with a reductive gas at high temperatures. The reduction is carried out at temperatures lower than the sintering temperature of the reduced metal compound so that the formed reduced shaped bodies, while maintaining their original dimensions to a large extent, have a density less than that of the metal compound used. The metallic matrix obtained in such a manner can be subjected to a post compaction by applying mechanical forces. High-strength steel parts having very low residual porosities and a high geometric tolerance are obtained by sintering the matrix at usual sintering temperatures after compaction.

15 Claims, No Drawings

METHOD FOR MANUFACTURING METAL PARTS

The invention presented here concerns a powder metallurgy process for the production of metal parts.

Powder metallurgical manufactured metal parts are used in areas such as the automotive industry, power tool and lock industries, to a substantial extent. Thereby, it is possible to differentiate essentially between two manufacturing methods, namely: the classical press sinter technique (PM) which includes the particular process of sinter forging and the metal injection moulding procedure (MIM).

Parts produced by means of the classical PM procedure are characterised by simple shapes (geometry), based on the fact that they are made from relatively coarse powders which are unidirectionally pressed. Therefore thin bars, close drillings, as well as bevels and undercuts are difficult to access using this method. Typical weights range from a few gram (e.g. bolts in the lock industry) up to approximately one kilogram within the automobile area (e.g. oil pump runners, chain wheels; ABS sensors). Manufacturing costs of such parts are low. Apart from the above-mentioned form restriction, the small mechanical maximum stress of classical PM sections is unfavorable. These generally possess densities below 7 g/cm$^3$ and indicate, thereby, a substantial volume of internal pores.

This results in a strong notch sensitivity of these parts, which does not permit the application of classical PM parts in change-loaded applications (e.g. high-speed gear wheels in transmissions). Although it is possible to increase the densities of PM parts by means of double-press-technique to values within the range of 7 up to 7.2 g/cm$^3$, an approximately nonporous matrix with material densities above 7.4 g/cm$^3$ can only be achieved by complex sinter forging.

In order to increase the unsatisfactory material density of classical PM-parts, attempts were made in the past to add small size metallic powder (e.g.carbonyl iron powder) to the coarse PM powders in order to improve the sinter activity. Apart from the high raw material costs and problems related to separation of the two types of powders during the production process, these early attempts were unsuccessful due to the fact that small sized powder particles penetrated into the gap between stamps and stencil and lead to increased wear and tear on the pressing tools.

The procedure of the metal injection moulding (MIM process) offered a method of producing parts with increased density and this process has increasingly gained industrial recognition during the past 10 years for the serial production of geometrically complex metal parts. Despite material densities above 7.4 g/cm$^3$ which are related to good mechanical tensile strength, so far the application of these parts is limited. Reasons for this limitation are due firstly to the high raw material costs of small-sized metallic powders, which limit the economical boundary regarding competitive manufacturing methods to weight-parts of below approx. 50 g. Also, MIM parts shrink substantially during the manufacture process, so that a max. controllable part size results. Under consideration of usual tolerance specifications these parts are limited to a diameter of approx. 50 mm. Due to the above-mentioned reasons, a typical MIM part has a weight from approx. 2 to 20 g and manufacturing costs are clearly beyond the price level of classical press sintered parts.

With the procedure of the metal injection moulding, small sized metallic powders (particle diameters typically <22 m, 90%-point) are kneaded with a binder to a homogeneous mass (feedstock) with a good rheology. The proportion of binder required to make the feedstock flow freely is thereby dependant on the density of the metallic powder used and its morphology. Typical values range from 5 to 15% by weight. The binder, which is no longer present in the final product (the sintered steel part), performs the function of coating the surface of the metal particles in order to make the feedstock flow uniformly in the operational sequence without significant separation taking place.

Most of the industrially used binder systems are based on the interaction of the following three components: removable component (C1), polymer (C2) and surface-active aid (C3), the details of which are described later on.

This feedstock, which possesses the flow characteristics of filled thermoplastics, is converted to molded articles (green parts) on conventional moulding machines. This step of the procedure corresponds to the well known shaping principles of plastic injection moulding and thereby permits easy access to geometrically complex articles.

In a following process step the component C1 representing the predominant proportion of the binder is removed from the green part. This results in a second part (brown part), whose external geometry is practically identical to that of the green part and whose form is held together by a polymer (component C2). By removing the component C1 pores are created, which allows the gases formed during the following pyrolysis of the polymere skeleton to leave the part without building up an internal gas pressure which would result in damage of the component by blisters and breaks. Types of binder mixtures where C2 and C1 are homogeneously soluable into each other are state of the art, as well as types where those two components form discrete phases after cooling.

The component C1 can either be removed thermally, chemically, microbiologically or solvent-based.

Described are procedures during which the component C2 is a polymer of one of the following classes: polyolefins, polystyrene, polyamide, acrylates, celluloseacetat, polyacetale.

In order to suppress separations between binder and particle phase during the moulding step, in most binder systems a surface-active component C3 is added to permit a homogeneous wetting of the surface of the metal particles by the binder.

The brown part is sintered later in the presence of H2, or H2/N2-mixtures or under vacuum at temperatures below the melting point of the alloy. During the first step of heating, the components C2 and C3 are decomposed and the brown part shrinks during consecutive sintering step under internal compression around the original percentage by volume of the binder. This shrinkage in x, y, z-direction is thereby approximately isotropic and its extent depends upon binder proportion and composition with typical values of approx. 13–20%. For a given geometry of the final sintered part, the lay but of the green part has to be done accordingly in x, y, z with a length impact from SF=1.13 to 1.20.

The origins of this concept go back to ideas of K.Schwarzwalder who, in 1937, described the production of ceramic spark plugs utilising this principle. Other work in the 40's, are related to the manufacture of components for uranium enrichment systems involving shaping of nickel powder by means of organic binders/L2/. However, this concept was only taken up and transferred to industrial production at the end of the 70's based on the patents of Rivers/Lit3/ and Wiech/Lit4/. The basic patents related to the manufacturing concept of moulding metal or ceramic powders by means of organic binders have expired or their concepts have been described in earlier work. Therefore the patent situation is commonly regarded as being free.

Meanwhile binder mixtures "ready to be used" are commercially available by various suppliers. In the following section, three different concepts are described as examples which broadly outline the general possibilities for the multiplicity of the industrially procedures.

EP-PS 125,912 describes a procedure where a wax C1 is mixed with a thermoplastic component C2 of the type listed above and processed accordingly.

EP 0,465,940 B1 describes a thermoplastic mass with C2 representing a polyolefin and C1 a Polyoxymethylen, whereby C1 is removed by acid catalysis and C2 is later driven out by pyrolisys.

D-OS 38 08 123 describes a procedure with that the binder consists of C2=polyethylene and C1=Oleicaciddecylester, whereby in order to increase internal wetting of the metal particles by the binder, an ethyl acrylic acid copolymer is added as surface active component. C1 is extracted from the green part by a solvent e.g. alcohols and or chlorinated hydrocarbons.

The pyrolysis of carbon-containing binder components particularly those with larger wall thicknesses often results in an uncontrolled accumulation of carbon into the matrix of the metal particles.

Since in iron based alloys the mechanical properties suffer from C-levels exceeding approx. 0.9 weight %, O.Z. 0050/40736 describes a special procedure to improve the binder in the MIM-Process by the addition of 2 to 30 weight %, preferrably 4 to 10% of a high-surface-rich carbonyl-ironoxide with a specific surface ranging from 10 to 120 $m^2/g$, preferably 70 to 110 $m^2/g$. This oxide is intensively ground with the metallic powder and added to the the binder. According to patent specification this reduces the accumulation of carbon into the metallic matrix, as the oxide reduces the carbon proportion formed by binder pyrolysis.

Although the procedure of the metallic powder injection moulding offers various technical possibilities, the comparatively high raw material costs limits its economy in relation to competitive manufacturing methods with increasing part weight.

With respect to high material costs a part with a weight exceeding approx. 20 g can generally be produced more economically by means of investment casting. The raw material costs of investment casting (costs of the melt) are much lower than those of the MIM process (small sized powders). This disadvantage becomes still more evident, if one considers that with the MIM procedure the systems-inherent shrinkage during sintering leads to an unsatisfactory statistics of the final dimensions particularly those of larger parts. Therefore, the larger the parts, the higher the raw material costs will be due to the increasing percentage of "off spec" parts.

U.S. Pat. No. 4,445,936 resp. U.S. Pat. No. 4,404,166 describes a method to increase the accuracy of MIM parts which involves placing these parts into a press die and calibrating the metallic matrix with parallel plastic deformation, after sintering at 2150° F. (1177° C.) has been completed. According to patent specification higher accuracies are obtained by the described calibration process without formation of cracks and it is claimed that the density is only slightly increased with respect to the sintered part. It is stated that if oxides are used as component of the feedstock, sintering under hydrogen at approx. 1200° C. (2150° F.) results in parts with are ductile "if treated with a hammer" and that the volume of the sintered part has undergone substantial shrinkage in relation to the originally formed geometry. The patent merely describes a procedure where articles molded according to the MIM-Process are sintered first and are calibrated in a consecutive step, i.e. the final product is the calibrated sintered compact with its geometry corresponding accurately to the geometry of the calibration form.

Due to high raw material costs of MIM, various attempts have been undertaken which involve the usage of less expensive metal powders such as water atomized powders or grinded powders/Lit6/. Unfortunatelly, all these cheaper powders are coarse-grained (>40 my) and of irregular structure. Based on the fact that small size particles are required in order to have a feedstock with a good rheology (moulding of the green part) and to achieve a high sinter activity (high density of the final part) it has been proved that the mechanical characteristics of the final parts are of a much lower standard if coarse powders are used. This has been examined thoroughly in the literature/Lit3/.

The synthesis of small-sized metallic powders could conceivably be achieved by reduction of powders of the corresponding metal compounds (in particular their inexpensive oxides) in an upstream process step. Unfavorable, however, is the fact that for thermodynamic reasons, an almost complete transformation of these oxides requires temperatures at which the metallic powders which are to be produced already show a substantial sinter activity. This high sinter activity—which is necessary for the MIM process—has the disadvantage that the metallic particles which have just being formed start to frit together at the grain boundaries. This gives rise to the formation of irregularly-formed agglomerates.

Due to this morphology, the rheologic characteristics of a feedstock manufactured by an upstream reduction of corresponding metal compounds are unsatisfactory. Feedstock systems based on this principle would need untenably high binder quantities to render it mouldable. This high binder content has, however, many disadvantages and among other things leads to separations in the green part—which in the sintered final part would result in imperfections such as moulding lines and inhomogenities of its density. The sintering of the primary particles during reduction of their metal compounds can be minimized by lowering the temperature during the reduction process. However, in most cases, this approach leaves the chemical reaction incomplete, resulting in a more or less undefined mixture of metallic powder and parent compound. If this mixture were to be used in the MIM-Process, sintering would end up with an undefined shrinking of the parts.

In order to circumvent this problem, it is theoretically possible to add compounds in small concentrations to the reaction mixture in order to prevent the particles from sintering.

These types of additives would be chemically stable at the temperatures required for a complete reduction of the metallic precurser (approx. 550–750° C.) and would decompose or disappear at higher temperatures. Thus, the effect of the additives would be limited to the step of the powder manufacturing, without disturbing the sinter process as the final step of the MIM procedures, which runs at higher temperatures.

However the disadvantage of employing this approach is that the upstream process step requires additional financial investments for the manufacturing of the powders, so that, ultimately, the raw material costs are not reduced to the desired extent. Furthermore, the handling of these powders on a technical scale requires extensive safety precautions, since such powders are sensitive to self-ignition under air, even at ambient temperatures, due to their high-specific internal surface.

The aim of the present invention is to extend the economical and technical limits of the MIM-process significantly. This is to be achieved by substituting the expensive metal powders—currently used in the state of the art MIM process—with their unreduced corresponding compounds, which are much cheaper. At the same time, the process presented here minimizes the shrinkage factor during the sintering step and thereby makes it possible to produce larger parts under consideration of both technical and economical aspects.

This is achieved by not mixing the binder with the small size metallic particles themselves, but with their corresponding unreduced metal compounds (e.g. as inexpensive oxides). These are subsequently reduced in a step further downstream followed later to the shaping of the green part. During this reduction process the shape given in the moulding step is preserved when the formed body is treated with a reducing gas at a higher temperature. However, this temperature is below the sintering temperature of the metal.

The temperature which is required will depend upon the redox potential of the specific cation and rises with an increasingly noble character of the metal e.g. rising from Cu (approx. 270° C.) over Ni (approx. 650° C.) to Fe (approx. 700° C.). The reduced moulded articles possess a high, accurately-controllable porosity and an accordingly small density. They will be economically manufactured based on simple principles within close geometrical tolerances.

Basically, any reducible metal cation in free or complex form may be used with any inorganic or organic anion. However, the degradation products thus formed under reducing conditions should be volatile or at least should not interfere with the properties of the metal part being formed. Compounds with anions such as; oxides; hydroxides, sulfides, nitrates, carbonates, formates, oxalates, acetates or metallate (e.g. parawolframat) as well as mixtures of such compounds may be used.

For economic and ecological reasons, oxides or mixtures of different oxides as well as ammonium metallates are preferred, particularly since these compounds exhibit a comparatively high metal content with respect to a given weight.

Apart from the fact that the binder compounds should not undergo any unwanted chemical reaction with the metal/metal compound particles at the processing temperature, the composition of the binder is not subjected to any technical limitation.

Therefore, any commercially available binder systems which are offered for the MIM technology can be used, particularly those which are based on the well-known principle of combining an extractable compound with a polymer that may be pyrolized.

Since the metal particles in the binder are in their oxidized state, aqueous extractable binder systems can be used without problems related to corrosion being involved. Removing the binder can be done in almost any state of the art process. It has been found, however, that tolerances of the reduced part are better if the polymer of the binder is pyrolized under oxidizing conditions (e.g. in air for example or air nitrogen mixtures) and/or under steam-containing atmospheres at temperatures of approximately 400 and 950° C. Usage of this atmosphere avoids both a parallel sintering of the highly porous matrix as well as uncontrolled carburizing of the matrix. The first would take place if pyrolysis is done under gases such as hydrogen and would result in uncontrolled shrinkage of the part. The latter would lead to an unwanted expansion of the part. Taking this into account, the porous matrix formed by reduction can be made accessable within tight geometrical tolerances.

For adjustment of tight geometrical tolerances of the porous articles, it has also been found to be favourable to abort the reduction in the proximity of the equivalent point. This prevents an uncontrolled sintering of the formed highly porous matrix, which would result in an unwanted volume-shrinkage.

Most significantly, it has been found that when considering the aspect of high dimensional accuracy it is favourable to strut the matrix on its surface during the early stage of the reduction, by incorporation of foreign atoms. This is done in order to supress an uncontrolled sintering of the reduced metal matrix with progressive reduction. This strutting can be carded out in a simple way by making use of carbon-containing gases, although it must be taken into account that the temperature should be above the temperature of the Bouduard-reaction, otherwise an uncontrolled formation of soot on the freshly formed metal surface will occur. On the other hand the temperature should be kept below the sintering temperature. To minimize an uncontrolled carburizing of the metal surface it has been found to be beneficial to add ammonia to the carbon-containing reduction gas.

The above-mentioned procedure can be performed easily in the following way: initially the matrix is treated by carbon-containing atmosphere—strutting—which is generated by simply feeding a low-molecular organic compound (e.g. a short-chain alcohol) into the reactor with the addition of aqueous ammonia solution. After achieving a certain degree of conversion (which is dependant on the surface area and general shape of the part to be reduced), the atmosphere is changed and the reduction is completed under hydrogen.

During the investigation of the characteristics of the highly porous metal matrix formed in the above-mentioned way, it was surprising to observe that this matrix demonstrated a ductile flow behavior transverse to the press direction if mechanical forces were applied. This unusual behavior makes it possible to obtain complex shapes with almost homogeneous density across the part by simple press technolgy, even if the compaction of the pororus body is done in a simple press with undivided press stamps.

Materials produced in such a way demonstrate excellent mechanical characteristic values after they have been sintered. The combination of excellent material properties coupled with an easy-to-run process extends the possibilities of the powder metallurgy considerably.

The porous articles formed by reduction as described above can:

- be used directly as open-porous metal foams (catalysts, shock absorber) due to their low density
- be converted by infiltration or CVD-procedure into steel parts, with reduced porosity and completely new material properties, while still maintaining their x, y, z-geometry
- be pressed in z-direction before sintering, due to its ductile flow behavior under maintainance of the xy geometry, following which it is sintered to final density
- be sintered under shrinking in x, y, z-direction in analogy to the conventional MIM, due to its high sinter activity The present invention circumvents the disadvantages of the current state of the art and describes a process which reduces the raw material costs of the MIM process to a minimum and which requires only small additional investments.

This is achieved by not mixing the binder with the small size metallic particles themselves, but with their corresponding unreduced metal compounds (e.g. as inexpensive oxides). These are subsequently reduced in a step further downstream followed later to the shaping of the green part. During this reduction process the shape given in the moulding step is preserved when the formed body is treated with a reducing gas at a higher temperature. However, this temperature is below the sintering temperature of the metal.

This procedure is not restricted to special binder systems and will be explained in more detail using the following examples, which were developed using a commercially available binder composition (model binder). Taking into account that the particles of the matrix are in an oxidized state so that problems with corrosion do not need consideration, it is possible to use water-soluble binders.

EXAMPLE 1

A mixture of binder components commonly used in the MIM process (C1=longchain ester; C2=Polymere (Polyamid), removable component C3=fatty acid) purchased through company TEKON (Marktheidenfeld Germany) is kneaded with commercial iron ore (Magnetite: Fe3O4) (purified by upstream flotation process to a purity of 99.5%, having an average particle diameter of 6–8 my). After 5.92 weight % of Carbonyl Nickelpowder (INCO 123) (% related to Fe3O4+Ni) has been added, the mixture was kneaded at 175° C. to result in a homogeneous feedstock. The binder content required for the processing amounts to 9.3 Gew % with respect to the total mass of final feedstock. From this feedstock, shaped parts (green parts) have been made on a conventional moulding machine with a average weight of 10.49 g.

After the component C1 has been removed by 12 hour extracting in acetone the resulting brown part was flushed with Hydrogen or hydrogen containing gas mixtures for several hours at temperatures between 550 and 1250° C. This intervention reduces the shaped oxidic part to a highly porous metallic matrix. The density of the particles change when the original metallic oxide (5.1 g/cm$^3$) is reduced to iron (7.86 g/cm$^3$), so that additional free volume is formed inside the matrix during the reduction of the oxide of the shaped body.

If the transformation would take place with no change of the external dimensions, a voidage fraction of approx. 65% by vol. would be expected, based on the simple theoretical consideration that the reduction process starts from a shaped part moulded with a feedstock of appr. 33% b.vol of binder and that approx. 32% of additional pores are created from the reduction of the oxide. However, since the transformation of the oxide matrix is already overlaid by a parallel sintering of the highly reactive metal particles being formed at temperatures above approx. 650° C., the theoretical voidage fraction of 65% will not be achieved.

The extent of this shrinking process was found to depend essentially on the reduction temperature, the duration of the reduction, the gas composition and the specific gas feed (m3 H2/h/kg of brown part).

Typical values for total shrinkage expressed as SF-value are between SF=1.03 (transformation temperature Tmax below 600° C.) and SF=1.20 (Tmax=800° C.). In the following text the SF-value is understood to be the ratio between regarded length in the reduced or sintered part and its original length in the green part. If the reduction temperature is kept lower than 600° C. the surface diffusion is still low and the sinter processes results in a three-dimensional network of metal particles which are only stabilized by weak forces between the particles. Accordingly, the reduced parts are very sensitive to mechanical damage.

During reduction of the metal compounds the temperature profile has to be adapted to the geometry of the part, whereby high wall thicknesses require a rather slow rise of the temperature in order to achieve a uniform reduction across the matrix of the part.

If the temperature is increased too fast, the initial reaction rate is very high at the surface of the part, whereas inside the part the reaction rate is controlled by diffusion of the gases being involved. Since the rate of diffusion into the part (hydrogen) and the diffusion of water vapour in reverse direction is slower than the initial reaction rate, the reduction of the parts result in an almost total conversion at the surface near areas with nearly unchanged material inside the matrix.

Particularly at higher temperatures (>900° C.), at which temperature sintering processes start to play an important role, the three-dimensional particle network begins to shrink. Due to the difference of density between the starting oxide and the reduced metal the shaped body is under extreme internal stress during the reduction. An uncontrolled reduction will therefore end up in distorted parts with cracks.

It has been found that with parts commonly known to be suitable to the MIM-process by virtue of their geometry and wall thickness, the reduction works satisfactorily when it starts at a temperature of 550° which is increased to 800° C. within 3 to 8 hours.

Taking into account the fact that the oxide is in chemical equilibrium with the metallic product being formed, it has been found to be advisable to run the process with a surplus of hydrogen and to remove the water from the internal gas stream of the process.

In order to achieve a complete reduction of the oxide, the final temperature should be as high as possible.

The reduced porous body resulting from the process given above may be sintered to the final product in analogy to the classical MIM process. This can either be carried out in a separate procedure step or directly by further raising the temperature. It was found—particularly among parts with larger cross sections—that final sintering should preferably be carried out under hydrogen since at high temperatures a complete conversion of the oxide can be obtained.

The brown part given above was reduced at 850° C. and sintered at a temperature of 1280° C. over a period of 30 mins. under vacuum. The final density of the part was found to be 7.55 g/cm$^3$, which lies within ranges which can be expected in the conventional MIM-process.

In the conventional MIM process shrinkage is known to be a problem with respect to geometrical accuracy of the final parts. Taking into account that in the conventional MIM-process the SF-value is in the range of approx. SF=1.13 to 1.20, it becomes evident that the additional shrinkage factor resulting from the reduction process would make it increasingly difficult to end up with a well-defined part. Based on theoretical calculations of the process, the SF-value of the part defined above would be appr. SF=1.5. This makes it obvious that the process outlined above is not suited to make parts within high geometric accuracy. Particularly when the shape of the part contains different wall thicknesses, it is not possible to run the reduction at a temperatur profile which would ensure that no stress builds up inside the part.

It was found that problems of distortion and poor accuracy of the final parts could be overcome if the sequence of the process steps outlined above were altered.

EXAMPLE 2

The brown part defined in Example 1 is now pre-sintered in the absence of any reducing gases, resulting in a sintered compact which is referred to as the "invert sintered body" in the following text.

The invert sintered body is formed by heating the Fe3O4-brown part at 800 to 1360° C. (30 min time at maximum temperature) under nitrogen or vacuum. At temperatures exceeding approx. 750° C. an unexpected formation of gases is found which follows the usual thermal decomposition of the binder components in the low temperature range of approx. 350–500° C. The formation of gases starting above 750° C. can be attributed to the reaction of the cracked polymer with the Fe3O4 matrix of the brown part. This reaction leads to a decrease in weight, due the fact that Fe3O4 is partly reduced to FeO/Fe.

The degree of conversion which can be attributed to this reaction depends on the temperature and the gas atmosphere. If the invert sintered body is formed under vacuum the weight loss was found to range from approx. 4% (850° C.) to 28% (1360° C.). If the process was run under inert gases (e.g. N2) the weight loss was found to be slightly lower.

The invert sintered body thus formed essentially consists of the sintered starting material (in this example Fe3O4 with Ni). Depending on the maximum temperature of the process, the remaining porosity of the invert sintered body ranges from approx. 8% by vol. (at 1360° C.) to approx 32% by volume (at 850° C.).

The invert sintered body is very stable particularly if the pre-sintering is carried out at higher temperatures (as from 900° C.). Even if the part contains sections of relatively high wall-thicknesses it is free of deformations or cracks. The SF value obtained during pre-sintering depends upon the temperature, ranging from SF=1.01 (at 800° C.) to 1.15 (at 1360° C.). The statistical distribution of the characteristic length for different sections of the same series is comparatively small and is within max. +/−0.4% of the average value.

The micro-density of the open-porous structure is raised with increasing temperatures encountered during the pre-sintering step. This can easily be understood if it is taken into account that, parallel to the sintering step, a partial reduction of the Fe3O4-matrix takes place. Accordingly the micro-density was found to be 5.2 g/cm$^3$(pre-sintering at 700° C.) with higher values of 5.5 g/cm$^3$(pre-sintering at 1360° C.). The macron-density increases in same direction from 3.6 to 5.1 g/cm$^3$.

The invert sintered body is reduced to iron in a subsequent step, in analogy to Example 1. It was found to be optimal to run the reduction at approx. 900° C. under H2/N2. Reaction time needed depends on the wall thickness of the part with typical values from approx. 3 to 7 hours.

In contrast to the procedure described in Example 1, the overall shrinkage of the part is relatively low if the temperature is kept below 1000° C. Thus the SF value between invert sintered body and brown part was found to range from approx 1.005 to approx. 1.030 depending on the maximum temperature applied. This can be attributed to the fact that by pre-sintering of the unreduced matrix, a mechanically stable skeleton structure is formed with a remaining internal porosity of approx. 8%- to 32%. by volume. This depends upon the applied temperature as outlined above.

Due to the formation of this skeleton the shrinkage which takes place parallel to the reduction of the oxide occurs inside the part. Therefore, in contrast to Example 1 the outer geometry of the part is maintained whilst internal porosity rises around approx. 32% by volume.

Thus (depending upon pre-sintering temperature) the part is left with a porosity of 43 to 65% after reduction.

In contrast to the directly reduced brown part of Example 1, the reduction of the invert sintered body results in non-distorted parts which are almost free of any cracks even at moderate process temperatures.

The macro-density of the reduced invert sintered body was found to range from approx. 2.6 to 4.2 g/cm$^3$ depending upon the process conditions. The micro density was found to be independent of the pre-sintering temperature. The experimental value of approx. 7.5 to 7.7 g/cm$^3$ corresponds very closely to the theoretically maximum value which is possible for this alloy.

The tensile strength of the reduced invert sintered body corresponds to that of plastics, however demonstrates no behavior of elasticity. The tensile strength of the parts increases with rising pre-sintering temperature. A typical value of approx. 70 N/mm$^2$ was found with pre-sintering at 1345° C. followed by reduction in H2 (900° C.; 3 hours).

Despite their high porosity, these parts could be considered as playing a potential role in those applications where, in principle, the mechanical properties of plastics would be sufficent but where plastics are unsuitable due to their poor heat resistance and low heat conductivity.

The tensile strength of the parts can be increased slightly if the porous body is infiltrated by polymerizable monomers e.g. a mixture of isocyanates and polyole forming polyurethane in the matrix.

If the reduced invert sintered body is sintered in a consecutive step at higher temperature (e.g. under vacuum at 1320° C. for 1 h) the tensile strength rises to approx. 300 N/mm$^2$ with a macro-density of approx. 5.3 g/cm. The remaining porosity of these parts is in the range of 25% by volume.

EXAMPLE 3

If the process is conducted with no temporal and spatial separation of the pre-sintering and reduction steps (as given in Example 2), the lack of intermediate cooling makes it possible to process parts at comparatively low pre-sintering and reduction temperatures without formation of any cracks.

In analogy to Example 2 a load of 150 brown parts—the composition of which is given in Example 1—is fed to a hot belt furnace flushed with N2.

A heating rate of approx. 20° C./min is calculated for the parts, based on the technical data of the furnace, the temperature of the 5 heating zones (300/600/900/900/900° C.) and the speed of the belt. Once the parts had reached the heating zone No. 4 (900° C.) the belt was stopped and the load was held 30 min under N2. Afterwards the furnace was flushed with 1.5 Nm$^3$ H2/h whereby the oxide compounds of the pre-sintered brown part was reduced to iron within 2 hours. It was found to be optimal to use a mixture of hydrogen and nitrogen with parallel removal of the water vapour formed from the internal gas stream.

The parts formed during this process (which are called DI-parts in the following text=directly inverted) show almost the same geometrical size as the brown parts if temperature is appr. 900° C. It was found that the SF values can be controlled by adjusting appropriate process parameters and no cracks are found among the parts.

The optimal process conditions depend on the shape of the parts, especially their specific surface, the specific loading of the furnace and the water vapour concentration. The latter depends upon other process parameters of the furnace, such as gas throughput and furnace volume.

If the specific loading of the furnace is high, it is surprising to find that DI-parts are produced which are even larger than the assigned brown parts (values up to SF=0.89 are found).

From the volumes of the removed binder and the reduction shrinkage (reduction from Fe3O to Fe) a volume of internal pores should be expected in the range of 65% by volume. The experimental findings indicate that, under appropiate process conditions, it is possible to remove the binder and reduce the oxide whilst still maintaining the outer geometry with formation of a high, homogeneous distributed internal porosity.

It is not surprising that the DI-parts manufactured in such a way show a low tensile strength with typical values in the range of 10 to 20 N/mm$^2$. However, with respect to their low macro-density of approx. 2.6 g/cm$^3$ they can be considered to be promising candidates in those applications where metal foams are discussed (e.g. hot gas filters; crash absorbers). Thus far, these metal foams are not made from steel since the state of the art process for the manufacturing of such foams depends upon the low melting points of their alloys (e.g.decomposition of TiHx in aluminium and Zn-melts).

EXAMPLE 4

The DI-parts manufactured according to Example 3 were sintered at high temperatures (e.g. 1320° C. at 1 h under vacuum). The parts shrank, as expected, during sintering and the macro-density increased to approx. 7 g/cm$^3$. At the same time, the tensile strength rose to approx. 400 N/mm2.

Surprisingly, it was found that, despite a shrinking factor of more than SF=1,3, it was possible to keep the tolerances of the final sintered parts within comparatively close limits. It Was found that the statistics of the characteristic length was within +/−0.7% and is, therefore, not substantially higher than those of the usual MIM process.

EXAMPLE 5

A cylinder with diameter 27 mm and height of 25 mm was manufactured from the feedstock given in Example 1.

The green part was de-binded and the brown part obtained thereby processsed under N2/H2 as given in Example 3 (reaction time 5 hours at 900° C.). The highly porous DI-part which was obtained in this way (density 2.74 g/cm$^3$) was almost unchanged in geometry showing a diameter of 26.85 and a height of 25.0. This part was put into a pressing tool consisting of a stencil (diameter 27 mm) equipped with an upper and lower stamp. The part was compressed at a given mechanical pressure. It was found that the compressed article called PDI in the following text (Pressed after Direct Inversion) exhibited increasing density with rising pressing power.

This PDI was sintered subsequently under vacuum (10° C./min; 1320° C. for 1 h). It was found that density of the sintered body corresponds to the density of the PDI. Thus, sinter density is increased with pressing power. If the part is compressed by a pressure of max. 6 t/cm$^2$ (which is a common pressure in the press and sinter mettallurgy) the density of the PDI reaches approx. 6.4 g/cm$^3$ which—after consecutive sintering—resulted in a final density of 7.5 g/cm$^3$.

If high pressures were applied (15 t/cm$^2$) the PDI reached a density of 7.14, which led to a sinter density of 7.62 g/cm$^3$. The fact that the density of the sintered body was lower than the theoretical value of the alloy being formed (FeNi8=theor. approx. 7.9 g/cm$^3$), has to be attributed to a small fraction of impurities in the raw material, which had not previously been purfied (Fe3O4-content>99.5%).These impurities, which were present in the ore, were visible in the cross section of the sintered part under a microscope. They were found to consist of phosphates and silicates in the x-ray analysis.

Since the diameter of these homogeneous distributed inclusions is very small, (usually approx. 1 my, in some cases up to approx. 10 my) they do not influence the material properties. Thus, with the material tensile strength was measured from approx. 650 to 720 N/mm$^2$ at HB values of >200. This is remarkable, since according to its history the material contains practically no carbon.

The metallographic testing of the parts proved that the metallic matrix of the material was extremely fine-grained, absolutely homogeneous and nonporous. If the sintered body was hardened and heat-treated in a consecutive process, then the hardness rose to 52 HRC with a simultaneous increase of the tensile strength to values >1000 N/mm$^2$.

When a synthetic ferric oxide (commercial Bayferrox®) is used as raw material, a inclusion-free metallic matrix was achieved as expected. With respect to the excellent mechanical values which were even obtained starting from mined ore, according to the invention there is no need to use the more expensive synthetic oxide.

The tensile strength and notched-bar impact-strength of the materials manufactured according to the procedure given in Example 5 are high. Even if the pressing power applied to the PDI is only 2.6 t/cm$^2$ and the sinter density of the final part, consequently, is only 6.95 g/cm$^3$, the tensile strength still exceeds 500 N/mm$^2$.

These high values are in contrast to conventional PM materials with comparable densities.

The substantially small notching sensitivity to impact with these parts and the significant higher tensile strength are surprising and may be due to the extremely fine-grained structure of the sintered body. Thus, material properties can be obtained which are clearly superior to those of conventional PM parts which are produced using the same pressure. It is evident that using a given press performance larger parts may be produced according to the priciples of the invention.

For the protection of the press stencil it proved appropriate to soak the highly porous DI at least partly with a commercial oil before embarking on the pressing step. This low viscosity oil is squeezed out of the PDI during pressing and leads to a more homogeneous density distribution In the pressed body. In contrast to the classical press sinter technique there are no powders, but a soakable porous molded article involved in the pressing step. So that the service life of the pressing tools can be substantially increased without the formation of a powder-oil paste.

With rising density of the PDI (i.e. with rising pressing powers) the porosity of the DI-part is increasingly eliminated by compression in z-direction. After pressing has been completed, the remaining porosity in the article disappears when sintering to final density. This leads to a sinter-shrinkage which is uniform in all directions. With regard to technically controllable pressing forces (appr.6 t/cm$^2$) the parts may be compacted to a density of approx. 6.4 g/cm$^3$, so that the remaining sinter-shrinkage in x and y direction is approx. 5.5% (SF=1,055). This value is much lower than that which would be obtained using the same material class through the classical MIM-route (with FeNi8 approx. SF(MIM)=1.175). Therefore, it can be stated that, according to the principles of the present invention, it is possible to produce larger components within a given class of geometrical tolerance.

In general it was found that the accuracy of the final parts depends on their geometry and the degree of compression before sintering. If parts are compressed to a density of approx. 6.4 g/cm$^3$, tolerances of less than 0.3% related to the target length become controllable. This high degree of accuracy makes it unnecessary to calibrate the parts after sintering.

EXAMPLE 6

In the classical press sinter technique the compression of a powder-based body is easy to manage as long as the article has only one characteristic length in z-direction (e.g. the cylinder of the Example 5). This procedure becomes increasingly difficult when areas of more than one single height are involved. With these parts each area with an individual length in z theoretically requires its own stamp. As each stamp has to work independently of the others, the underlying presses and tools are accordingly very complex and expensive. In particular it becomes very difficult if parts are to be made which show a continuous change of Z-values across a given area in x,y (e.g. parts with a diagonal edge or parts with undercuts in press direction).

These parts require either extremely complex tools or additional machining of the sintered part.

Theoretically these problems should also be expected with the compression of the DI-parts of the present invention. Surprisingly however it was found that the highly porous matrix of the parts given in Example 5 exhibits a ductile pressing behaviour. During the compression of these parts the porous matrix possesses the ability to balance density variations within certain limits in x and y direction. That means when mechanical forces are-applied to the matrix the material starts to flow transverse to the press direction. Based on this ductile behaviour a rather complex bevel gear wheel can be produced in a simple pressing form. The pressing form simply consists of three part, namely: a divided stencil, an upper and a lower stamp. The bevel gear wheel has a module of 0.76 and a diameter of D=53 mm. The porous body was compressed with 6 to/cm$^2$. Despite the fact that the height varied from 2 mm (edge of the gear wheel) up to 6 mm (near the center) the final density of the sintered part was found to be 7.48 g/cm$^3$ (1320° C.; 1 h; Vacuum). The surface hardness amounted to uniformly 209 to 212 HSB187/2.5. The reproducibility of the diameter was excellent, with a tolerence of +/−0.06 mm.

EXAMPLE 7

Attractive technical aspects evolve if the above mentioned compression characteristics are combined with the fact that—in contrast to the conventional press sinter technology—the press step of the presented invention does not start from a heap of powder, but a well-defined, homogeneous article. This makes it possible to shift the figuration-defining-line of the pressing tool apposite to the outside edge of the component, within certain limits. This can be understood more clearly using the example of a gear wheel. If this part is made according to the principles of conventional press-sinter-technology, the identity between the outer dimensions of the part and those of the stamp would be inevitable. In consequence the gear wheel often shows an unacceptably sharp formation of a flash at its outer edge which could result in intolerably high local forces and could lead increased wear and tear on its counter part.

If the gear is made according to the principles outlined in the present invention, this problem is easy to overcome simply by employing a different design of the pressing tool. Here the figuration-defining-line is not identical with the outer line of the gear but runs parallel to this line shifted slightly to the centre of the gear wheel. In this way R is possible to give a round shape to the edge of the gear wheel.

Obviously if the tool is designed in the way described above an undercut is formed in press direction. The areas covered by this undercut would not be filled with powder according to the principles of conventional press and sinter technology. In contrast to this, the ductile flow behaviour of the porous matrix developed in the present invention is able to fill this covered areas with material flowing perpendicular to the pressing direction. It was found that there is no gradient in density with the final sintered gear wheel.

Release of the pressed part is made possible by the presence of a second splitting line in the tool, which was closed when the porous matrix was introduced into the cavity before the upper and lower stamps compressed the part.

EXAMPLE 8

To some extent the ductile flow behaviour addressed in Example 7 makes it possible even to fill those volumes in the mould which do not have an equivilant contour in the porous body, i e. the porous article does not inevitably have to represent the form of the compressed body expanded in press direction.

It has been demonstrated that this procedure clearly extends the boundries of shaping possiblities compared to the conventional press sinter technology. Using this approach, a simple way to manufacture positiv-fit connections between two workpieces is outlined in the following example.

A compressed porous body is manufactured in analogy to Example 5 (part No. 1; press density 6.4 g/cm$^3$). This part is put in the cavity of a second pressing tool. A porous body (part No. 2; density 2.6 g/cm$^3$) is manufactured according to Example 3. Part No 2 is also placed in this tool. Both parts are designed in a way that during compression both parts form a single component by virtue of the fact that material of part 2 is free flowing into corresponding areas of part 1. Making use of this this co-pressing principle, both parts are combined to form a single unity. As long as the individual volumes of both parts show the same density before sintering a non-distorted sinter part will be obtained. Due to high local pressing forces plus high sinter activity of the small size particles, the original interface between the two parts disappears completely during the sintering process.

The idea of multiple co-pressing can not be realized with conventional press and sinter technology. On one hand, this is due to the fact that it is not possible to fill a cavity of a pressing tool homogeneously with powder around an inserted part. On the other hand, the sinter activity of the coarse size powders used in conventional PM is so poor that the interface between two individual co-sintered sections does not disappear.

Therefore, the geometric size of parts which can be made by conventional PM-technology is limited by the pressing forces that can be managed. A maximum of appr. 100 cm$^2$ can be given as a rule of thumb.

Following the principles outlined above, it is possible to gain access to very complex shapes such as those with a high space-filling requirements or parts with open areas located perpendicular to each other. These complex geometries can not be pressed in a single step from powders, but it is possible to built them up based on two (or even more) co-pressed unities.

The concept of co-pressing a porous matrix (based on material B) around a pre-pressed first body (based on material A) provides a simple way of producing parts with sections from different materials as long as a compatible sinter-regime can be found for both materials.

It is obvious that, making use of the principle given above, the range of parts that could be made is vastly expanded compared to those produced according to conventional press and sinter technology.

EXAMPLE 9

As described above, the reduced porous matrix and the body resulting from its compression do not necessarily possess the same shape in the way that the latter is merely the flat version in z-axis of the first one.

Since the material exhibits ductile flow characteristics, it is possible to manufacture parts with various heights in a cavity of almost the same geometry as the porous body. This could be achieved on the principle that the quantity of material needed to raise the density of the porous body (appr. 2.6 g/cm$^3$) up to the final density in the pressed part (e.g. 6.4 g/cm$^3$ based on 6 to/cm$^2$ pressing force) may be stored in a volume that is located in the rear of the cavity. During the pressing step the material stored in this volume is pressed into the cavity by means of a simple stamp. Based on the figures given in Example 3 the additional volume needed is calculated to be 2.52 times that of the cavity itself.

Particularly concerning those parts where small but complex sections of the part are combined with larger but simple sub-structures (i.e. with one height) the additonal volume can be added to the simple substructure. Thereby, a complex part may be manufactured based on a simple design of the pressing tool.

The application of this principle can also be used to make parts of slightly different shape from the same basic mould—e.g. individual keys with the same basic design. The porous body of the basic key would be moulded in a non-diversified general mould whereas the pressing tool is equipped with the characteristical set of sub-structures needed for the production of the various individual keys.

The ductile flow behaviour of the porous matrix opens a wide range of challenging technical options. Nevertheless ductility is limited and therefore it is obvious that the density in the pressed body gets more inhomogeneous the more complex the shape of the pressed body. Therefore, a pressed part with a complex shape can not be expected to be as homogeneous as a simple structure such as the cylinder of Example 5. In consequence, local structures with lower density are found when parts of complex shape are sintered.

Fortunately it was found that even within those areas where the part demonstrates a lower density, the tensile strength was still found to be acceptably high, and with low notch sensivity. This was studied in more detail and it was found that compression of the porous matrix to poor values such as approx 5 g/cm$^3$ still resulted in a density of 6.9 g/cm$^3$ in the sintered part with a tensile strength of approx. 500 N/mm$^2$ (material FeNi8).

Altogether the process presented here offers a clear competitive advantage in comparison to the conventional MIM-technology. Material properties of both are similar. The process is attractive by virtue of its low raw material costs, plus a low shrinkage factor.

The combination of these features also permits the production of parts with non-supported sub-structures that are usually regarded as being prone to bending during sintering. As the raw material is cheap and the shrinkage factor is low, it is possible to support these critical sub-structures in such a way that additional material is added underneath to stabilize the structures during sintering. The additional material is removed by machining once the part has been sintered.

This could not be realized in conventional MIM as the raw material costs are too high to include additional material that is not found in the final part.

As given in the examples above the porous matrix must be inserted into the cavity of a pressing tool. Cycle-times of a few seconds are necessary for this production step in order to minimize the costs. The pressing itself is very fast, needs no preservation time at high presure and could be achieved in cycle times of less than 1 second. The rate-determining step is therefore associated with the time needed to feed the part to the mould. For economical reasons this can only be done automatically. Since the stability of the porous matrix is high enough automation does not cause any problems, provided the porous body can be produced within tight tolerances.

It is not difficult to meet tolerances if simple structures are involved. Parts which are slightly smaller than the press cavity would leave a gap between press form and porous body. However, this gap can easily be filled with material once the body starts to be compressed. Likewise, a certain oversize is permitted if the press form has an introduction bevel and so blunt-cutting of material at the form edge is avoided. It becomes more critical however, if during insertion of the porous body sticks are to be met. This is due to the fact that the highly porous material can tolerate thrust forces without problems, but would be torn apart at tensile of more than approx. 10 to 20 N/mm$^2$ This gives rise to the following problem. If a porous body with the geometric shape of an "8" is pressed, the corresponding press tool must be equipped with two pins. If the porous body is slightly too small, the part is put under tension when it is inserted into the cavity; if tension exceeds the above-mentioned value the part will be torn, whereby the the two fragments formed during rupture, depart from each other during early stage of the pressing. If sufficient material is present in vincinity of this rupture, then it will close completely during further pressing due to the ductile flow behavior of the remaining material and due to the high sinter activity, the material will be homogeneous following sintering. Even at the site of the closed rupture the sintered part will demonstrate the same high tensile strength as the remaining matrix.

If the material cross section at the nodal point of the "8" is small however, then the ductile flow is not fast enough to transport material from neighbouring sections to close the rupture perpendicularly to the actual pressure gradient. In this case damage remains within the part even following sintering. For the reasons mentioned, with most parts it is mandatory to keep tight tolerances in the porous part with x, y. As order of magnitude a deviation of +−1.5% can be given as rule of thumb.

As indicated earlier, the reduction of the oxidic brown part requires a diffusion of the reducing gases (e.g. H2) into the matrix. Thus, when pure hydrogen is used smaller sections will already be completely reduced, whilst sections with high wall thicknesses will still show a high oxide content in the centre. This diffusion line between metallic oxide and the more reduced metallic matrix can often be detected clearly with the naked eye. As shown in Examples 1 and 2, reduced material demonstrates a certain sinter activity even If temperature is below the usual sintering temperature. This leads to small cross sections of the porous body being subjected to substantial shrink, whilst at the same time material located in larger cross sections is not reduced completely and, therefore, does not shrink.

Extensive attempts showed that it is almost impossible to run the reduction process with pure hydrogen if parts of critical geometry (i.e. parts with different wall thicknesses and sticks) are to be produced within the tight tolerances required for the pressing step. The problem became even more critical when the process was scaled up to production size due to inhomogenity of the gas concentration and temperatur profiles in the reactor.

Attempts were made to lower the sinter activity of thin-walled geometries by adding coarse water-atomized metallic powder to the feedstock system. Unfortunately, the mechanical properties of the sintered parts suffered from this aproach and higher pressing forces had to be applied. Although the statistics of the reduced part improved slightly, it was still unacceptable for automatic pressing.

EXAMPLE 10

Twenty-nine brown parts made from the feedstock of the Example 1 were manufactured, as described above. The weight of the green part was 10.5 g with the following characteristic length: diameter DX=25.42 mm; DY=25.42; height h=12.96 mm. These parts were placed on a perforated plate and located in a gas-sealed furnace equipped with gas circulation and a surplus gas burner.

The batch was heated up with 20° C./min. When 900° C. was reached, the parts were reduced under hydrogen (0.6 Nm3 H2/h) for two hours. The gas was flushed through the plate. After the parts had been cooled under Nitrogen the weight of the part was found to be 7.1 g due to extensive reduction of the oxide. The sections had a brightly grey metallic appearance. The thin-walled sections of the part (wall thickness 1.1*0.9 mm) shrank with SF=1.05 to 1.09 whereas in the thick-walled centre the SF-value was found to be SF=0.98 to 1.015.

When these parts were manual inserted into the pressing tool, the small sections of the part were torn off when they were placed around the pins in the tool.

The sintered parts which were produced from the pressed parts failed in the functional test due to the cracks that were formed in the pressing step.

The experiment was repeated with a gas mixture of CO/H2/CH4 (30/65/5 Vol. %) instead of pure hydrogen. After a reduction time of 2 hours the weight of the parts was found to range from 7.2 to 7.4 g. The parts showed a dark grey metallic appearance. The shrinkage factor was found to be uniform in x and y with values of SF=0.985 to 1.015. Carbon deposits were found on the surface of some parts, particularly within the areas of edges and thin-walled structures. This could be attributed to the decomposition of CO at the freshly formed iron surface, according to the principles of the Bouduard-reaction. Parts with C-deposits were found to have expanded significantly from initial DX=25.42 mm to values of 26.4 mm.

EXAMPLE 11

The experiment from Example 10 was repeated with addition of 5% by volume of NH3 to suppress the Bouduard-reaction. At the same time the reactor was fed with water in order to increase the O:C ratio of the circulating gas.

None of the parts showed a deposit of carbon after reduction. The SF-value was found to range from 0.975 to 1.02

EXAMPLE 12

One hundred and fifty brown parts as described in Example 7 were heated up to 900° C. in a gas tight furnace equipped with gas circulation. 20 l N2/min were flushed through the furnace. When 900° C. was reached 500 g/h of a solution of ethanol and ammonia was fed into the furnace for 2 hours (870 g of 96% ethanol with 130 g of 25-% aqueous NH3). The escaping gases coming off the furnace were fired. After 2 hours the batch was cooled under N2. The parts were metallically grey and showed a uniform weight ranging from 7.15 to 7.35 g.

No carbon deposit was visible at the surface of the parts. The SF-value was found to be uniform across the part with values ranging from SF=0.97 to 1.02. The fraction of non-conforming parts was 2.7%. The characteristic length was thereby identical to the length of the brown part within a spread of plus 0.4 to minus 0.2 mm.

The porous bodies could be fed to the press tool automatically. When parts had been sintered under vacuum at 1280° C., some parts demonstrated partial melting at local sections, indicating an intolerable high C-content.

EXAMPLE 13

Three hundred brown parts as described in Example 7 were heated up to 900° C. in a gas tight furnace equipped with gas circulation. 20 I N2/min were flushed through the furnace. When 900° C. was reached 1.1 kg/h of a solution of ethanol and ammonia was fed to the furnace for 1 hour (870 g of 96% ethanol with 130 g of 25-% aqueous NH3). The escaping gases coming off the furnace were fired. After 1 hour the feed of ammonious ethanol solution was stopped and the parts were reduced with Hydrogen for additional 2 hours at a flow rate of 2 m3/h. Thereafter, the batch was cooled under N2. The parts were metallically grey and showed a uniform weight of 7.12 g. The carbon content was found to be approx, 0.75%. The shrinkage factor ranged from SF=0.99 to 1.01.

The porous parts which were obtained were soaked with a commercially available mineral oil, supplied to a pressing tool and compressed at a total pressure of 28 to (corresponding to appr. 6 t/cm$^2$). The compressed parts demonstrated a macro-density in the range of 6.3 to 6.4 g/cm3 with a micro-density of 7.55 g/cm$^3$.

These parts were sintered at 1280° C. under hydrogen (7.5° C./min; 1 hour preservation time at maximum temperature). The sintered parts showed a weight of 6.98 g which was almost identical between each individual part. The macro-density of the sintered parts were found to be 7.5 g/cm$^3$. The characteristic length of the sintered part was found to be 24.2+/−0.08 in x,y with a characteristic height of 4.89 mm. The sintered parts were ductile, corresponding to the effect that their carbon content was almost zero.

The parts were hardened and heat-treated in a consecutive step by conventional means, at 940° C. with rapid cooling in an oil bath. The hardnesses of the parts was found to be 52HRC. With theses parts functional test were conducted, with a tensile of 2.2 kN being applied to the part. With respect to the cross-section a tensile strength of approx 1100 N/mm2 could be calculated from these figures.

EXAMPLE 14

Three hundred porous parts according to the procedure given in Example 13 were manufactured. However the porous body was then infiltrated with a concentrated solution of $Cu[(NH_3)]_4$-acetate and passed through a belt furnace flushed with hydrogen within 1.5 hour at 900° C. s. The $Cu[(NH_3)]_4^{2+}$ present in the porous body was thereby reduced to metallic $Cu^0$. The parts showed a slight copper colour on a metallically grey matrix, which was homogeneously spread throughout the complete part. These parts were processed as given in Example 13 (pressed, sintered, hardened an heat treated).

The tensile strength of the parts was found to be improved by approx. 10% with respect to the parts without Cu-infiltration.

What is claimed is:

1. A process for producing a ductile metal body of defined geometry, comprising:

mixing metal compound containing particles with a binder, molding this feedstock to shaped parts, removing the binder thereafter and reducing the metal compound containing body with a reducing gas at higher temperatures which are below the sintering temperature of the reduced metal compound wherein a binder is used containing a removable compound together with a stable compound, taking off the removable fraction of the binder and treating the body thereby obtained at temperatures between about 550 and 1050° C. thereby the stable part of the binder mixture is decomposed to gaseous compounds and removed from the shaped body with subsequent pre-reduction of the body under carbon containing atmosphere, wherein the pre-reduction under the carbon containing atmosphere comprises feeding a low molecular weight compound to the atmosphere at temperatures above the decomposition point of CO according to the Bouduard-reaction.

2. The process of claim 1, wherein the removal of the stable binder compound is carried out in an atmosphere containing oxidizing gases such as in the presence of air or steam.

3. The process of claim 1, wherein the pre-reduced body is subsequently reduced with hydrogen at temperatures above about 550° C.

4. The process of claim 1, wherein the feed of reducing gas to the reactor is stopped when formation of water is decreasing indicating the end of the reduction.

5. The process of claim 1, further comprising compressing the reduced body compressed to final parts.

6. The process of claim 5, further comprising heating the compressed body up to sintering temperature.

7. The process of claim 1, further comprising sintering the porous body obtained from reduction directly to final parts.

8. The process of claim 5, wherein the porous body to be compressed does not represent the expanded version of the shape of the compressed part to be sintered, by making use of the ductile flow behavior in the way that the material of the porous matrix is partly forced to flow perpendicular to the press direction.

9. The process of claim 5, wherein a lubricant is added during the compression of the porous body or that the porous body is at least partly infiltrated by such a lubricant before pressing.

10. A process for producing a ductile metal body of defined geometry, comprising:

mixing metal compound containing particles with a binder, molding this feedstock to shared parts, removing the binder thereafter and reducing the metal compound containing body with a reducing gas at higher temperatures which are below the sintering temperature of the reduced metal compound wherein a binder is used containing a removable compound together with a stable compound, taking off the removable fraction of the binder and treating the body thereby obtained at temperatures between about 550 and 1050° C. thereby decomposing the stable part of the binder mixture to gaseous compounds and removing the binder mixture from the shaped body with subsequent pre-reduction of the body under carbon containing atmosphere, wherein the porous body received after reduction of the metal compound or the brown part itself is infiltrated with a reducible cation comprising $Cu[(NH_3)]_4^{2+}$-solution.

11. A metal body produced according to the process of claim 1.

12. A process for producing a ductile metal body of defined geometry, comprising:

mixing metal compound containing particles with a binder, molding this feedstock to shaped parts, removing the binder thereafter and reducing the metal compound containing body with a reducing gas at higher temperatures which are below the sintering temperature of the reduced metal compound wherein a binder is used containing a removable compound together with a stable compound, taking off the removable fraction of the binder and treating the body thereby obtained at temperatures between about 550 and 1050° C. thereby decomposing the stable part of the binder mixture to gaseous compounds and removing the binder mixture from the shaped body with subsequent pre-reduction of the body under carbon containing atmosphere, wherein the removable fraction of the binder is taken off by solvent extraction.

13. The process of claim 1, wherein said low molecular weight compound is a low chain alcohol.

14. The process according to claim 13, wherein said method further includes adding ammonia together with said low chain alcohol.

15. The process of claim 9, wherein said lubricant is selected from the group consisting of a mineral oil and a stearate.

* * * * *